United States Patent [19]

Marion

[11] 4,303,352

[45] Dec. 1, 1981

[54] METHOD FOR THE BUILDING AND PUTTING IN PLACE OF A SEA PLATFORM WITH A GRAVITY RESTING BASE, AND MEANS FOR IMPLEMENTING SUCH A METHOD

[75] Inventor: Henri A. Marion, London, England

[73] Assignee: Compagnie Generale pour les Developpements Operationnels des Richesses Sous-Marines, Paris, France

[21] Appl. No.: 51,858

[22] Filed: Jun. 25, 1979

[30] Foreign Application Priority Data

Jun. 26, 1978 [FR] France ..... 78 19004

[51] Int. Cl.[3] ..... E02B 17/02

[52] U.S. Cl. ..... 405/206; 405/207; 405/209

[58] Field of Search ..... 405/203, 204, 205, 206, 405/207, 209

[56] References Cited

U.S. PATENT DOCUMENTS

| | | | |
|---|---|---|---|
| 2,574,140 | 11/1951 | Boschen | 405/204 |
| 3,064,437 | 11/1962 | Knapp | 405/206 |
| 3,965,688 | 6/1976 | Jensen | 405/205 |
| 4,087,984 | 5/1978 | Mo | 405/207 |

FOREIGN PATENT DOCUMENTS

| | | |
|---|---|---|
| 2172497 | 9/1973 | France . |
| 2179433 | 11/1973 | France . |
| 2261925 | 9/1975 | France . |
| 2343863 | 10/1977 | France . |
| 7611325 | 4/1977 | Netherlands . |
| 1440229 | 6/1976 | United Kingdom . |

*Primary Examiner*—David H. Corbin

*Attorney, Agent, or Firm*—Wigman & Cohen

[57] ABSTRACT

The invention relates to a method for the building and putting in place of a sea platform in using buoyancy chambers. The buoyancy chambers are temporarily attached to the raft and capable of being ballasted for allowing the control of their buoyancy during the building of the structure and their recovery. Simultaneously with the building of the tower and walls, the chambers are progressively built by assembling of portions of bodies mounted on a bottom element resting on a chamber receptacle.

10 Claims, 12 Drawing Figures

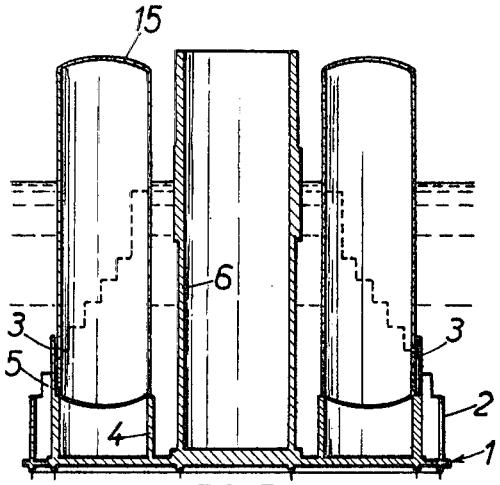
FIG.:5
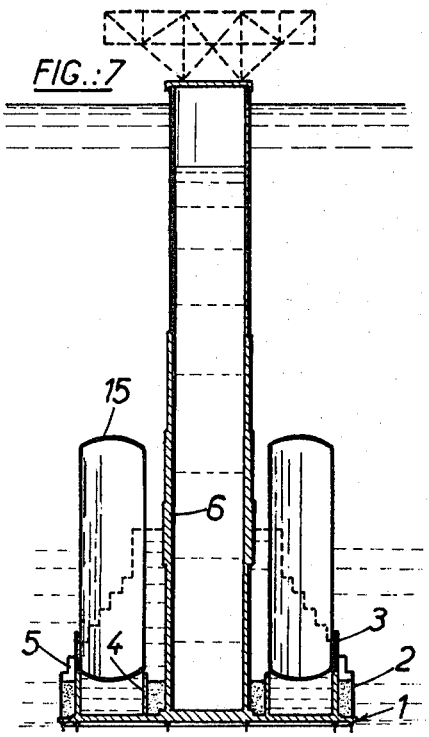
FIG.:7
FIG.:6
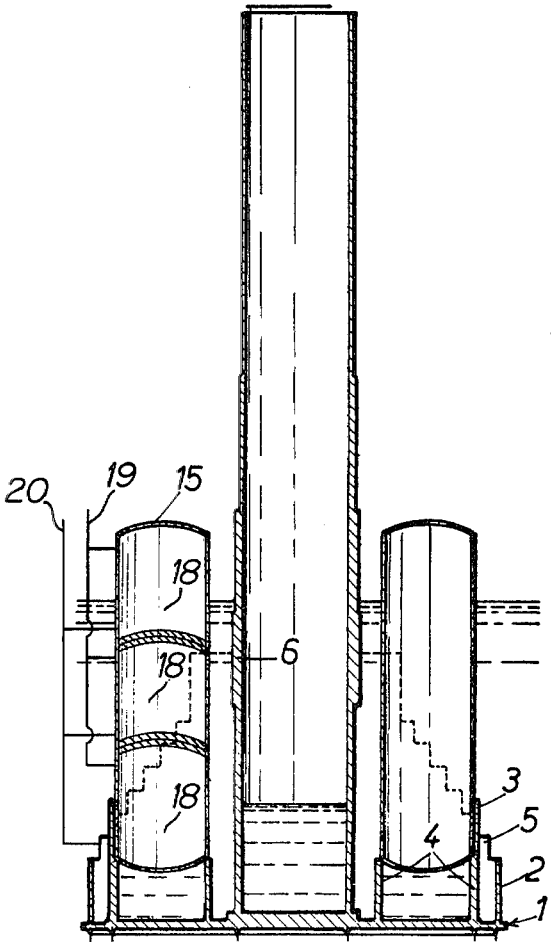
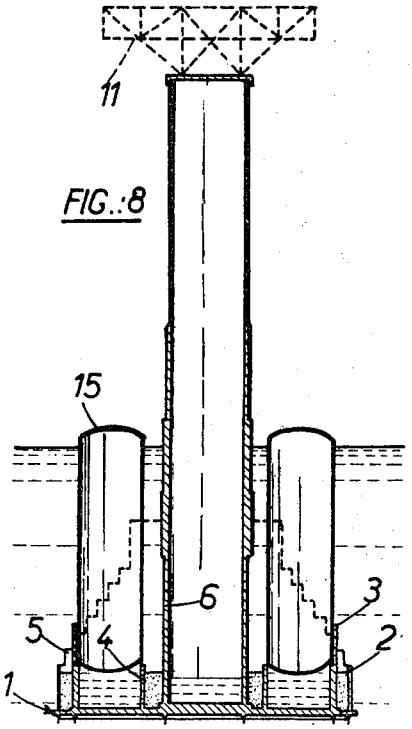
FIG.:8

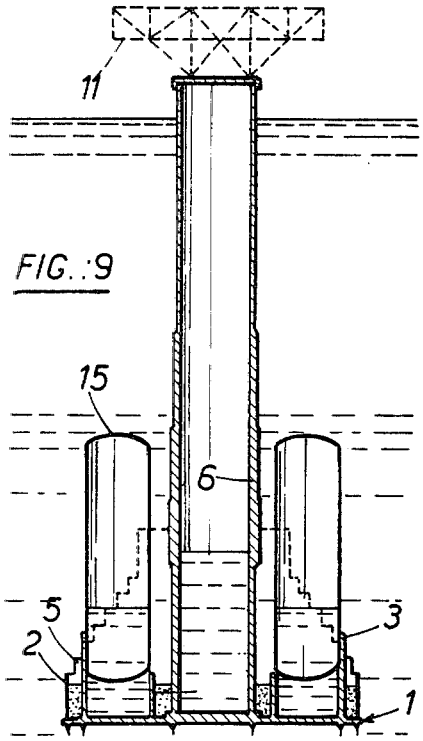
FIG.:9
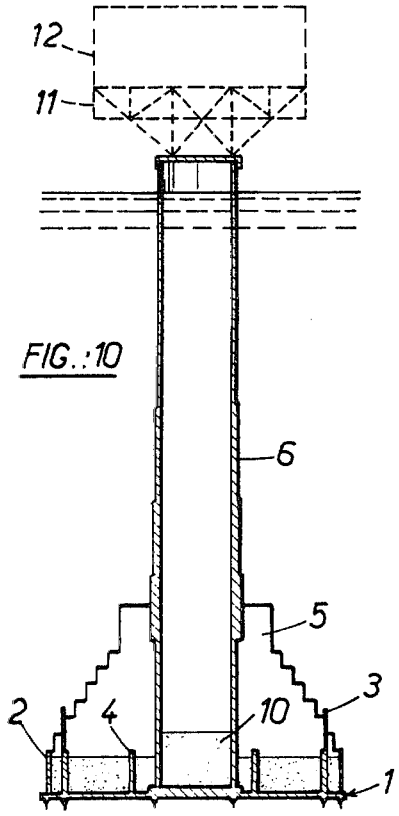
FIG.:10
FIG.:12
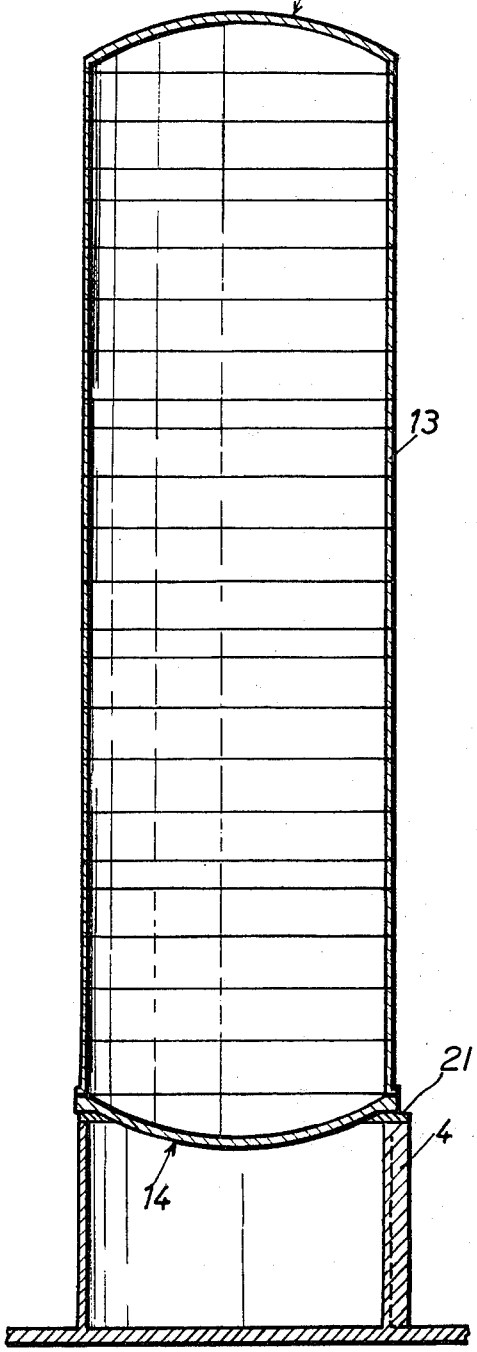

METHOD FOR THE BUILDING AND PUTTING IN PLACE OF A SEA PLATFORM WITH A GRAVITY RESTING BASE, AND MEANS FOR IMPLEMENTING SUCH A METHOD

The invention relates to a method for the building and putting in place of a sea platform with a gravity resting base, including the use of buoyancy chambers, and to means for implementing such a method.

One knows already sea platforms comprising a foundation raft, a buoy forming enclosure, a tower and superstructures.

The raft is formed of a slab, stiffened by several rows of concentric girders and by diaphragm walls joining the central chimney, or tower. On the upper end of the tower is fixed a bridge supporting the modules forming the dwelling and service rooms, and the prospecting and working facilities. The buoyancy chamber forming enclosure of lobed or circular form, is built on the raft, and rest on the radial diaphragms disposed around the chimney. During the building, a suitable load of water is introduced into said enclosure in view of controlling the balance and adjusting the draught. For the putting in place on the chosen ground, sand is put inside for ballasting the structure.

According to a method currently used for the building of such structures, the vertical walls are made with the sliding shuttering method, and all the elements of the structure are cast nearly simultaneously.

The volume of the circular enclosure is determined according to the apparent weight during the various steps of the building, towage and installation on the chosen place. The volume so realized can be used for stocking the crude oil and the ballast. However, these possibilities of use are not always workable, and there is then provided a useless thing or too much important but which has nevertheless cost an important mass of concrete and iron for its building.

It is an object of the present invention to provide a novel and improved platform in which one or several of the buoyancy chambers are used only for the building and immersion process on the bottom, and can be disassembled after the putting in place.

So as to render easier the disassembling of the buoyancy chambers, these are formed by volumes temporarily attached to the raft and capable of being ballasted for allowing the control of their buoyancy during the building of the structure and their recovery.

It is an other object of the invention to provide a method for the building and putting in place of a sea platform with a gravity resting base comprising the following main steps:

(a) building in dry dock of the foundation raft, including a portion of the anti-underwashing walls, of the circular and radial strengthening walls, of buoyancy chamber receptacles, and of the base forming tower lower portion; water tightening of the antiunderwashing walls;

(b) launching of the base;

(c) simultaneous building of the tower, walls and buoyancy chambers, said chambers being built progressively by assembling of portions of bodies, mounted on a bottom element resting on the chamber receptacle, said portions assembly having a buoyancy adapted to the building step;

(d) ballasting of chamber receptacles during building of tower and chambers;

(e) closing the upper end of buoyancy chambers;

(f) completion of the tower, simultaneously with its progressive ballasting;

(g) immersion of the structure by means of ballast;

(h) putting in place of the bridge, draught adjustment;

(i) towage to the choosen place;

(j) immersion of the platform, by means of ballast;

(k) putting in place of the modules, ballasting the tower lower portion with solid ballast;

(l) disconnecting the buoyancy chambers, ballasting the chamber receptacles with solid ballast.

In a modified implementing of the method, the order of steps (k) and (l) is inversed.

The invention has also for its object means for implementing the above method, said means comprising buoyancy chamber receptacles forming a portion of the structural parts of the raft, and distributed according to a choosen configuration taking into account the structure and form of the base, and of the buoyancy chambers made of prefabricated elements to be united, temporarily resting water tightly on the chamber receptacles.

According to other embodiments, said means comprise buoyancy chambers including at least a bottom, a body and a cover, the bottom being an element adaptable temporarily watertightly to the chamber receptacle;

the chamber body is made of hollow parts, watertightly united;

the chamber body is made of watertight caissons, capable to be united together, and to be watertightly united on the receptacles;

the buoyancy chambers are made of parts providing a positive buoyancy;

said hollow parts are formed at least in part with a low density material;

said chambers are filled up with a liquid under pressure, of a density lower than that of the surrounding medium;

the chambers are fitted with admission and emptying devices for the ballast fluid.

Various other objects, features and attendant advantages of the present invention will be more fully appreciated as the same becomes better understood from the following detailed description of the present invention when considered in connection with the accompanying drawings, in which:

FIGS. 1 to 10 show the various steps of the building of a structure according to the invention;

FIG. 12 is a sectional view of a buoyancy chamber according to the invention.

Figure 11:
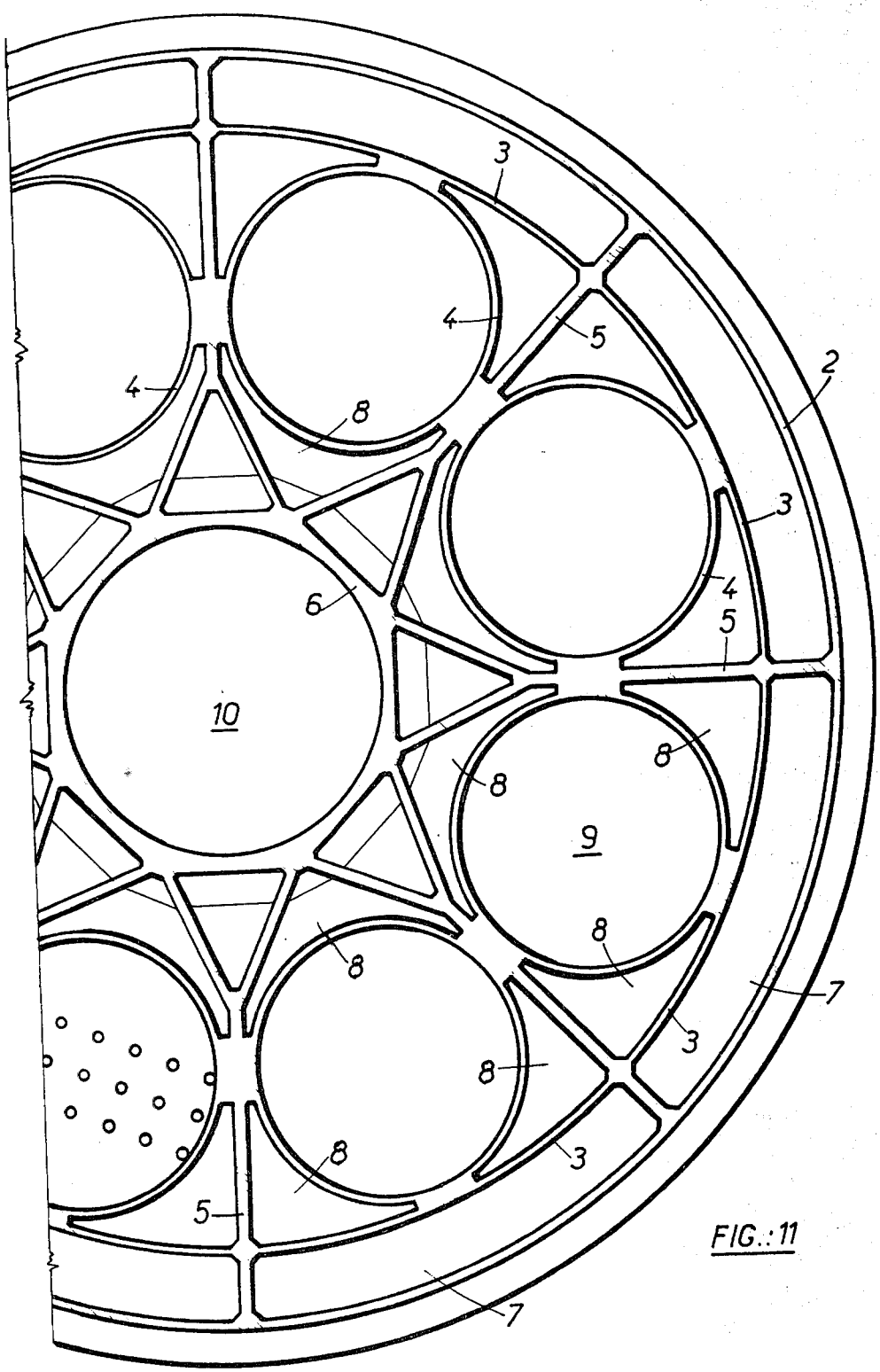
FIG. 11 is a top plan view of a structure base according to the invention.

FIG. 10 is a sectional view showing a platform with a gravity resting base, laid in situ on the sea bottom. Said platform comprises a foundation raft 1 on which are cast the anti-underwashing wall 2, the concentric reinforced wall 3, the chamber receptacles 4 and the diaphragm walls 5. The anti-underwashing wall, provided with apertures (not shown) along at least a part of its height, surrounds the raft. The diaphragm walls are radially disposed around, and from the tower 6 and strengthen its implantation on the raft. FIG. 11 is a sectional view from above the base and shows the implantation of walls and receptacles. The permanent ballast is stored in housings such as 7, 8, 9, 10, formed by the structure parts.

The top of the tower is covered by a bridge 11 having one or several floors, and on which are disposed the modules 12, forming the buildings and technical facilities for the oil exploitation and/or prospecting. In the shown embodiment, all the buoyancy chambers are temporary, but is is evident that said chambers may be used if desired on a base comprising also fixed chambers, utilizable for example as storage tanks. The implantation of the receptacles for the temporary buoyancy chambers is settled during the building of the base, and these receptacles cooperate to the structural strength of the assembly. The number and the disposition of these receptacles are settled according to the conditions of building of the structure, and to the form of the base.

The use of temporary buoyancy chambers causes an alteration of the building and of the putting in place of the completed platform, what results in the insertion in the conventional method of building and putting in place, of specific steps according to the invention. FIGS. 1 to 10 show the main steps of the method of building and putting in place according to the invention.

Figure 1:
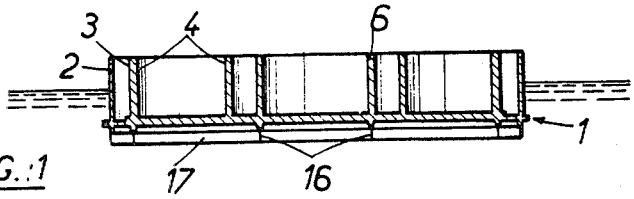
Figure 2:
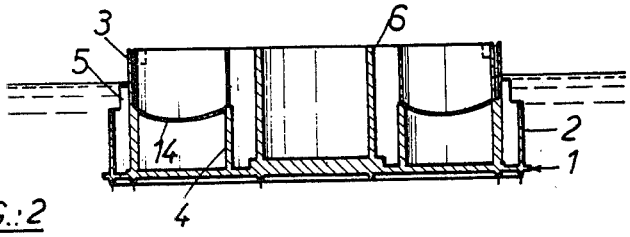
Figure 3:
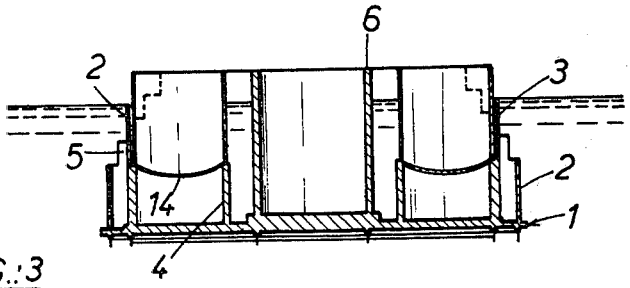

FIG. 1 shows the launching step of the base. The base has been build up partially in a graving dock or in a bed. The raft 1 itself has been cast with its permanent thickness on its periphery. The vertical walls, the anti-underwashing walls 2, the strengthening walls 3, diaphragm walls 5 and chamber receptacles 4, as well as the tower 6 lower portion have been made according to the sliding shuttering method, or any other suitable method. In this step, the walls are erected for example unto 15 meters. The raft 1 is fitted at its lower portion with devices 16 for anchoring in the ground. In the embodiment shown, these devices allow the formation of separated compartments, forming air bags 17, which in the launching step shown, improve the buoyancy of the assembly. The base is launched, or put on the water, after having temporarily rendered watertight the anti-underwashing wall. When the base is afloat, the air bag buoyancy is removed, and the walls are built further. The structure is balanced (FIG. 2) in ballasting the volume comprised between the anti-underwashing wall 2 and the strengthening wall 3. The simultaneous building of the tower, the walls and the buoyancy chambers is carried further. The chambers (FIG. 12) are built in assembling hollow prefabricated element 13, mounted on a bottom element 14 resting on receptacle 4. The assembled elements have a buoyancy adjusted to the building step. The bottom 14 is watertightly mounted on the receptacle 4, for example, by means of a seal 21. The sealed receptacle 4 thus forms a closed volume used as an additional buoyancy chamber. The volume comprised inside the strengthening wall 3 remains without water as long as the water level does not rise above the wall top (FIG. 3). Until then, the chambers and tower parts already built provide only an increase of the water draught, and one can see that the parts forming the lower portion of the chambers do not require to be watertight, or to provide a positive buoyancy.

Figure 4:
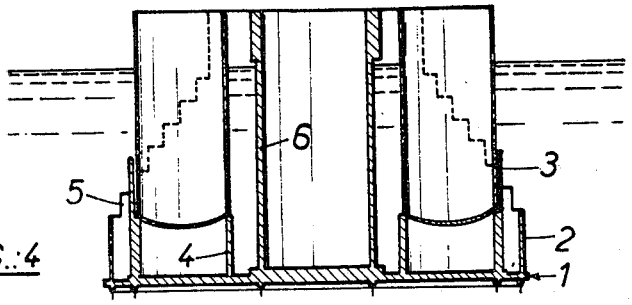

The building is carried on until that the water draught with respect to the structure height is deemed insufficient. The chamber receptacles are then ballasted (FIG. 4). The chambers building is achieved, and the tower building is carred further. The upper end of the buoyancy chambers is closed by means of a cover 15 (FIG. 5). The tower building is achieved simultaneously with the progressive ballasting of its inner volume (FIG. 6).

The structure is immersed (FIG. 7) in filling completely or not the tower, and in filling the base housings with a solid ballast, in view of setting the bridge upon the tower top (FIG. 8). The water draught of the tower is adjusted, and after that, the tower is towed unto the choosen place, where it is allowed to sink down (FIG. 9) in ballasting the chambers and the tower. The modules 12 are put in place (FIG. 10), and the tower base is ballasted with solid ballast. The chambers are disconnected from their receptacles, which then receive the solid ballast, necessary for the stability of the tower for a hundred years standing condition, in summer or winter.

When no obstacle occurs and that the steps may be achieved in the prescribed terms, the last two steps: putting in place of the modules and disconnecting the chambers can be done in the reverse order, without getting out of the scope of the present invention.

The implementing of that method is rendered possible by means comprising buoyancy chamber receptacles and buoyancy chambers.

The chamber receptacles form a part of the structural elements of the foundation raft and are distributed according to a given configuration, taking in account the structure and the form of the base.

FIG. 11 is a partial view of a base on which eight chamber receptacles are regularly distributed. Such a distribution and a number may be different, according to the size of the platform to be built, the form of the base and the presence or absence of permanent buoyancy chambers. As it can be seen on FIG. 11, the receptacles cooperate to the strength of the base and form a structural assembly with the strengthening walls 3, diaphragm walls 5 and tower 6 lower portion.

Each of the buoyancy chambers (FIG. 12) comprises at least a bottom 14, which can be adapted temporarily, watertightly, on a receptacle 4, a body 13 and a cover 15.

In a first embodiment of the invention, the chamber comprises hollow prefabricated elements which can be united together, e.g., the hollow elements 13 shown in FIG. 12. The body forming elements are concrete rings having their edges fitted with packing means and attaching means, allowing their temporary assembling. The end elements, bottom 14 and cover 15, are formed by portions of a sphere. According to a simplified method of building, the bottom and cover elements are not different and the periphery of the convex face is fitted with packing means for cooperating with the receptacle, as well as attaching means for the temporary fixation to the receptacle.

The buoyancy chambers are fitted with means for admitting and emptying the ballast fluid. The ballast fluid can be merely sea water, but can be also a fluid lighter than water, such as oil, or air under pressure. In the latter case, the fluid cooperates with the buoyancy and allows the reduction of strains caused by the pressure on the chamber walls.

In an other embodiment, the chambers are formed at least in part by watertight caissons 18, three of which are shown forming the left-hand buoyancy chamber of FIG. 6. The caissons 18 can be united together, and fitted with means for admitting and emptying the ballast fluid 19, 20, respectively. The water tightness between caissons is no longer necessary.

The connection of two adjacent caissons is formed by mechanical means. Only the connection of the bottom caisson and the receptacle needs to be watertight.

In a third embodiment, the buoyancy chambers are formed by elements providing a positive buoyancy. Such buoyancy is provided, e.g. by elements formed at least partially with a low density material, or by elements filled up at least partially with a low density material.

In the first embodiment, the rings are made of low density concrete and can be fitted on their inner surface with a crown of cellular material such as a foam of polystryrene or polyurethane, or another natural or synthetic matter.

In the second embodiment, the ring can be made of a concrete veil or of a metal sleeve. The rings are watertightly connected, as in the first embodiment and are filled up with a divided low density material. The chamber ballasting is provided by admission of sea water in the interstices of the material, or in free compartment provided in view of that during the building.

According to another way of implementing the invention, the elements are built in situ, e.g. according to the sliding shuttering method.

The temporary fixing of the chamber on the receptacle is provided by means of fasteners, which are cut for the disconnecting. Means allowing such disconnecting are not described since such are usual in this technical field.

In view of simplifying the examples, the buoyancy chambers are cylindrical, but it is understood that they can have another form, such as lobed or polygonal, without getting out of the scope of the invention. It is understood that many other modifications and changes will become apparent to those ordinary skilled in the art, and the present invention is intended to cover all such obvious modifications and changes which fall within the spirit and scope of the invention as defined in the appended claims.

I claim:

1. A method for the building and putting in place of a sea platform with a gravity resting base comprising the following main steps:

(a) building in dry dock of a foundation raft comprising a portion of anti-underwashing walls, circular and radial strengthening walls, buoyancy chamber receptacles and a base forming tower lower portion and water tightening the anti-underwashing walls;

(b) launching the raft;

(c) simultaneously building the walls, a tower and buoyancy chambers, said chambers being built progressively by assembling portions of bodies mounted on a bottom element resting on the chamber receptacle, said assembled portions having a buoyancy adapted to the progressive assembly;

(d) ballasting the chamber receptacles during building of the tower and buoyancy chambers;

(e) closing the upper ends of the buoyancy chambers;

(f) completion of the tower, simultaneously with progressive ballasting thereof;

(g) immersion of the platform by means of ballast;

(h) putting in place of a bridge, and adjusting the draught;

(i) towage to a selected location;

(j) immersion of the platform by means of ballast;

(k) putting in place of a module and ballasting the tower lower portion with solid ballast; and (l) disconnecting the buoyancy chamber and ballasting the chamber receptacles with solid ballast.

2. A method for the building and putting in place of a sea platform with a gravity resting base comprising the following main steps:

(a) building in dry dock a foundation raft comprising a portion of anti-underwashing walls, circular and radial strengthening walls, buoyancy chamber receptacles and a base forming tower lower portion and water tightening the anti-underwashing walls;

(b) launching the raft;

(c) simultaneously building the walls, a tower and buoyancy chambers, said chambers being built progressively by assembling portions of bodies mounted on a bottom element resting on the chamber receptacle, said assembled portions having a buoyancy adapted to the progressive assembly;

(d) ballasting the chamber receptacles during building of the tower and buoyancy chambers;

(e) closing the upper ends of the buoyancy chambers;

(f) completion of the tower, simultaneously with progressive ballasting thereof;

(g) immersion of the platform by means of ballast;

(h) putting in place of a bridge and adjusting the draught;

(i) towage to the selected location;

(j) immersion of the platform by means of ballast;

(k) disconnecting the buoyancy chambers and ballasting the chamber receptacles with solid ballast; and (l) putting in place of a module and ballasting the tower lower portion with solid ballast.

3. A gravity platform comprising:

a foundation raft having structural elements and adapted to reset on a sea floor;

an anti-underwashing wall formed on the foundation raft;

chamber receptacles forming a portion of the structural elements of the foundation raft, said receptacles being distributed according to a predetermined configuration;

a central tower having a lower part, said tower being joined to the foundation raft and chamber receptacles by means of diaphragm walls;

buoyancy chambers removably mounted on the chamber receptacles, the buoyancy chambers being removable from the raft and recoverable, leaving the raft disposed on the sea floor, said buoyancy chambers formed of prefabricated elements adapted to be connected together; and means for connecting the buoyancy chambers to the chamber receptacles in a watertight manner.

4. A gravity platform according to claim 3, wherein the buoyancy chambers comprise a bottom which can be temporarily adapted to the receptacle in a watertight manner, a body and a top.

5. A gravity platform according to claim 4, wherein the chamber body is formed of hollow elements connected in a watertight manner.

6. A gravity platform according to claim 4, wherein the chamber body is formed at least in part by watertight caissons connected to one another by mechanical means.

7. A gravity platform according to claim 3, wherein the elements forming buoyancy chambers are made at least partially with a material having a specific gravity lower than that of the surrounding medium.

8. A gravity platform according to claim 3, wherein the elements forming buoyancy chambers are filled at least partially with a material having a specific gravity lower than that of the surrounding medium.

9. A gravity platform according to claim 3, wherein said buoyancy chambers are filled with a fluid under pressure, said fluid having a density lower than that of the surrounding medium.

10. A gravity platform according to claim 3, including means fitted to said buoyancy chambers for admitting and emptying ballast.

* * * * *